US007882833B2

(12) United States Patent
Jacob

(10) Patent No.: US 7,882,833 B2
(45) **Date of Patent: *Feb. 8, 2011**

(54) PERIPHERY VIEW MASK AND REMOTE BREATHING ASSEMBLY

(76) Inventor: William J. Jacob, 324 E. 11th St., Ste. 101, Kansas City, MO (US) 64100

( * ) Notice: Subject to any disclaimer, the term of this patent is extended or adjusted under 35 U.S.C. 154(b) by 995 days.
This patent is subject to a terminal disclaimer.

(21) Appl. No.: 11/687,815

(22) Filed: Mar. 19, 2007

(65) Prior Publication Data

US 2007/0174952 A1 Aug. 2, 2007

Related U.S. Application Data

(63) Continuation-in-part of application No. 10/675,288, filed on Sep. 30, 2003, now Pat. No. 7,234,463.

(51) Int. Cl.
*B63C 11/02* (2006.01)

(52) U.S. Cl. ..... 128/201.27; 128/201.11; 128/205.25; 2/428; 2/430

(58) Field of Classification Search ..... 128/205.25, 128/206.12, 206.13, 206.21, 206.23, 206.24, 128/206.27–206.29, 201.11, 201.12, 201.27, 128/202.11; 2/9, 428–431, 209, 423; 351/43; 405/185, 186
See application file for complete search history.

(56) References Cited

U.S. PATENT DOCUMENTS 7,234,463 B2 * 6/2007 Jacob ..... 128/201.27

* cited by examiner

*Primary Examiner*—Steven O Douglas

(57) ABSTRACT

A remote breathing assembly includes a periphery viewable goggle or mask, intake and return air-tubes sealably connected to the goggle, and a breathing apparatus coupled to the tubes opposite the goggle. The goggle includes a transparent lens having a front section defining a lateral front length, and left and right sections extending transversely from the front section a distance not less than one-forth the front length, a compressible liner, an improved liner interface having trapezoidal sections, and a securing element for fixing the goggle and evenly compressing the liner. The air-tubes each present upper and lower ends, with the intake tube further presenting a flared end section at the upper end. A blower is connected to the flared end section and configured to direct air therein. The apparatus further includes at least one submersible handle and link.

20 Claims, 6 Drawing Sheets

PERIPHERY VIEW MASK AND REMOTE BREATHING ASSEMBLY

CROSS REFERENCES

The present application is a continuation-in-part and claims priority benefit with regard to all common subject matter of an earlier-filed U.S. patent application entitled "PERIPHERY VIEW GOGGLE AND REMOTE BREATHING ASSEMBLY," Ser. No. 10/675,288, filed Sep. 30, 2003, now U.S. Pat. No. 7,234,463. The identified earlier-filed pending application is hereby incorporated by reference into the present application.

BACKGROUND OF THE INVENTION

1. Field of the Invention

The present invention relates generally to snorkeling gear, and more particularly to a snorkeling apparatus improved to protect the eyes, nose and ears of a wearer from externalities, and configured to expose the wearer to conditions at a remote location.

2. Discussion of the Prior Art

Conventional goggles have been developed to protect the eyes of a wearer while performing hazardous activities. Conventional goggles typically comprise a frame, at least one transparent lens coupled to the frame, and means for securing the frame and lens to the face of the wearer during use. For some activities, such as swimming, the goggle provides an airtight chamber between the lens and the wearer's face.

Conventional goggles, however, present problems and disadvantages. For example, conventional goggle frames at least partially obscure the peripheral, upward and downward vision of the wearer. Another problem is the lack of protection typically afforded by these goggles to other parts of the wearer's face, such as the nose and ears, where it is appreciated that exposing these organs to certain fluids, fluid-borne particles, or microorganisms can cause illness or discomfort to the wearer. Yet another problem is presented by the circumscribing edge of conventional swim goggles, which are often required to be uncomfortably and sometimes painfully compressed against the soft tissues of the wearer's face in order to provide the air-tight chamber.

Finally, conventional goggles do not address the long-felt problems associated with the inability of humans to breathe underwater. Other conventional devices, such as snorkeling equipment, have been developed that expose underwater swimmers to ambient air conditions above the water surface. However, these devices problematically require the user to breathe through his or her mouth and manually maintain an open airway, while swimming at a proper depth under the water surface. Other devices have also been developed that facilitate underwater nasal breathing, such as Scuba diving equipment, however, these devices are generally too expensive, complex and simply inappropriate for most residential swimming pools and at shallow coastal depths.

SUMMARY OF THE INVENTION

Responsive to these and other problems, the present invention concerns an improved goggle for protecting the eyes, nose, and ears of a wearer, while not obstructing his or her forward, upward, downward and peripheral vision. The invention provided hereof, among other things, is useful for preventing illness and discomfort that can result from exposure to and retention of fluids, fluid-borne particles and microorganisms in these regions. The invention is also useful for intercommunicating an otherwise airtight chamber and ambient air conditions located at a remote breathing apparatus coupled to the goggle.

A first aspect of the invention concerns a periphery viewable goggle for protecting a portion of a wearer's face, including the eyes, from externalities, and for providing the wearer with seamless peripheral viewing. The goggle includes a flexible lens having transparent front, left and right sections, wherein said front section defines a lateral front length, and said left and right sections each extends transversely from the front section, presents a length not less than one-forth of the lateral front length, and forms no seam with the front section. A compressible liner is attached to the lens, and configured to form a seal between the lens and the wearer's face. A securing element for securing the lens in a fixed position relative to the wearer's face and compressing the liner is also included, so as to form an air-tight chamber between the lens and the portion of the wearer's face.

A second aspect of the invention concerns a securing element for securing the goggle lens in a fixed position relative to the wearer's face, and compressing the liner. The element includes at least one strap presenting an intermediate section, and the lens further defining a plurality of guides adjacent the upper and lower edge sections. The strap, liner and lens are cooperatively configured such that the guides are able to receive at least a portion of the intermediate section; and the intermediate section forms superjacent layers with the liner and lens generally adjacent the upper and lower edge sections, when received.

A third aspect of the invention recites a remote breathing assembly adapted for use with a human wearer in a body of water defining a water surface. The assembly includes a face mask presenting a water-impermeable outer shell and a compressible liner. The mask is configured to engage a portion of the face of the wearer, including the nose or mouth, in such a manner that the portion and shell cooperatively form an enclosed space adjacent the nose or mouth. A securing element is configured to compress the liner against the face of the user, so as to seal the enclosed space, and secure the mask in a fixed position relative to the portion. A first breathing tube defines an open inner tube space, a first tube end securely interconnected with the shell at a first location, a second tube end, and a tube length. Finally, a remote breathing apparatus is configured to float upon the surface and is securely coupled to the tube at or near the second end, such that the second end is retained in a relative fixed condition above the water surface. The shell defines an opening at the first location such that the tube and enclosed spaces are fluidly coupled.

Other aspects and advantages of the present invention will be apparent from the following detailed description of the preferred embodiment and the accompanying drawing figures.

DETAILED DESCRIPTION OF THE PREFERRED EMBODIMENTS

Figure 1B:
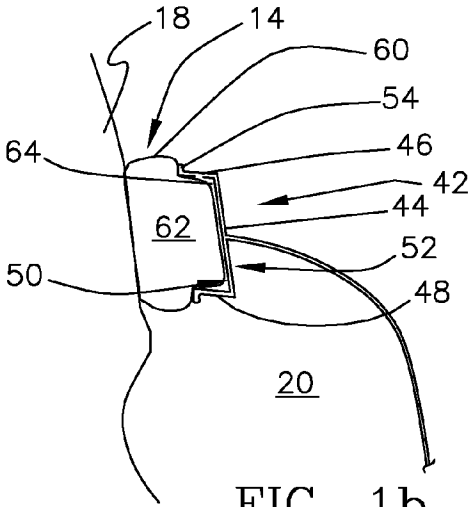
FIG. 1*b* is a fragmentary cross-sectional view of the goggle shown in FIG. 1, particularly illustrating the liner interface.
Figure 1A:
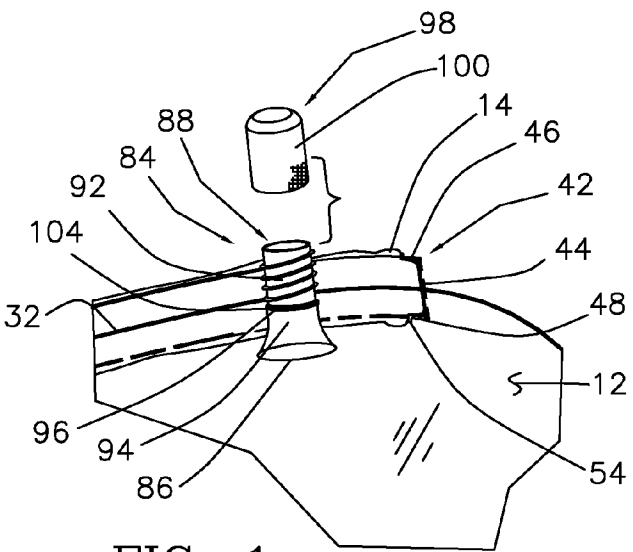
FIG. 1*a* is an enlarged fragmentary exploded view of the goggle shown in FIG. 1, particularly illustrating the air-tube stub.
Figure 1:
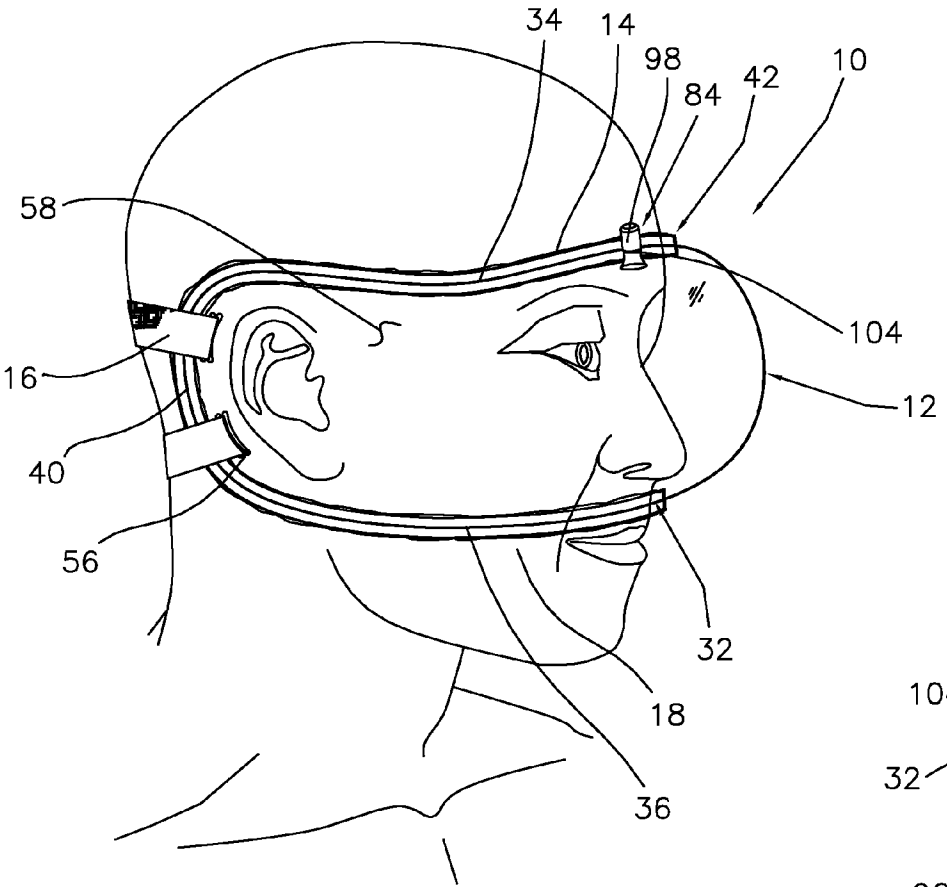
FIG. 1 is a perspective view of a preferred embodiment of the periphery view goggle being donned by a human wearer.

Turning first to FIGS. 1, 1*a* and 1*b*, an embodiment of the present invention includes a periphery view goggle 10 comprising a transparent U-shaped lens 12, a compressible liner 14 adhesively attached to the lens 12, and at least one strap 16 attached to the lens 12 for securing the goggle 10 and compressing the liner 14 against the face 18 of a human wearer. The protective goggle 10 is configured to cooperatively define an airtight chamber 20 between the lens 12 and that portion of the wearer's face 18 covered by the lens 12. The liner 14 is configured to form a seal between the lens 12 and the wearer's face 18, thereby, preventing the exposure of the covered portion of the wearer's face 18 to externalities, such as fluids, fluid-borne particles and microorganisms. Preferably, the encapsulated portion of the wearer's face 18 includes the nose, eyes and ears of the wearer, and the transparency of the lens 12 enables the wearer to maintain unobstructed vision in the forward, upward, downward and peripheral directions.

Figure 2:
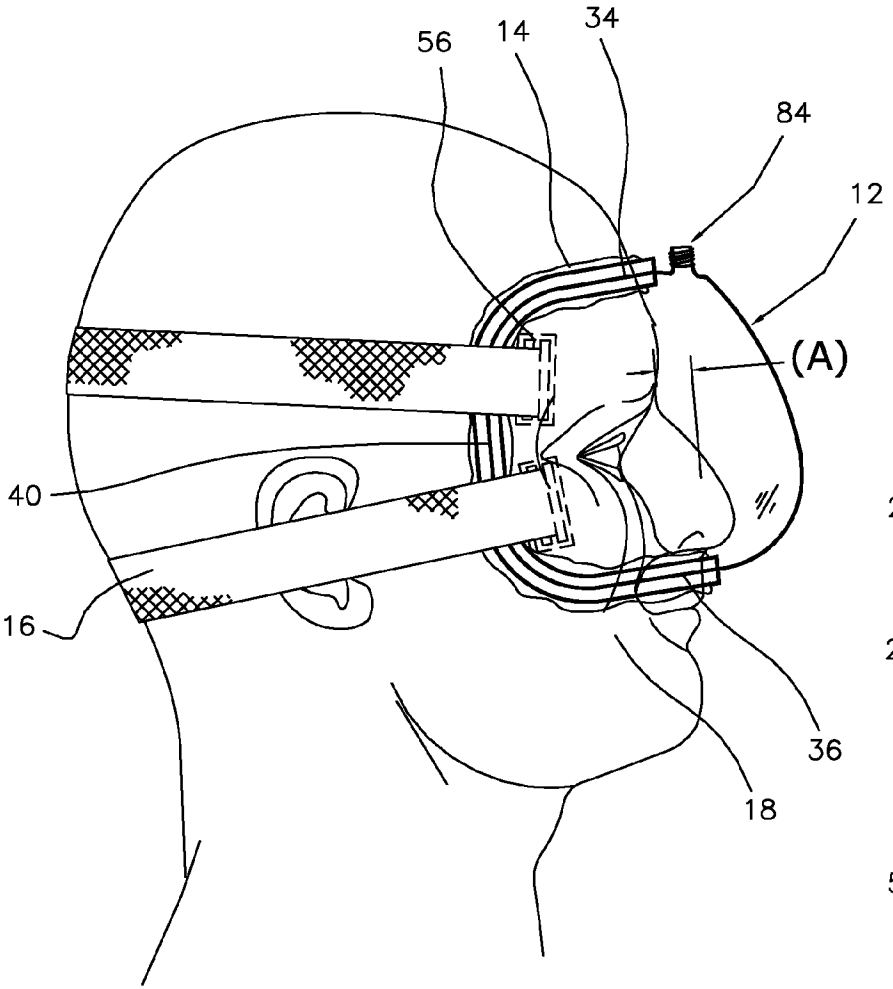
FIG. 2 is a side elevation view of a preferred embodiment of the periphery view goggle being donned by a human wearer, particularly illustrating the half teardrop shaped vertical cross-section.

The lens 12 preferably includes a unitary flexible body having a U-shaped horizontal cross-section and an arcuate shaped vertical cross-section. Alternatively, however, where a more streamline profile is desired to reduce drag, the lens 12 can present a half teardrop shaped vertical cross-section, as shown in FIG. 2. The arcuate shaped vertical cross-section of the lens 12 is sufficient to enable the entry of the median size nose and ears of a human wearer within a particular group size, i.e. small, medium, large, etc. More preferably, the lens 12 is configured so as to be able to retain up to 125% of the median size nose and ears of a human wearer within the particular group size. Most preferably, the lens 12 is custom fit to a particular human wearer.

Figure 3:
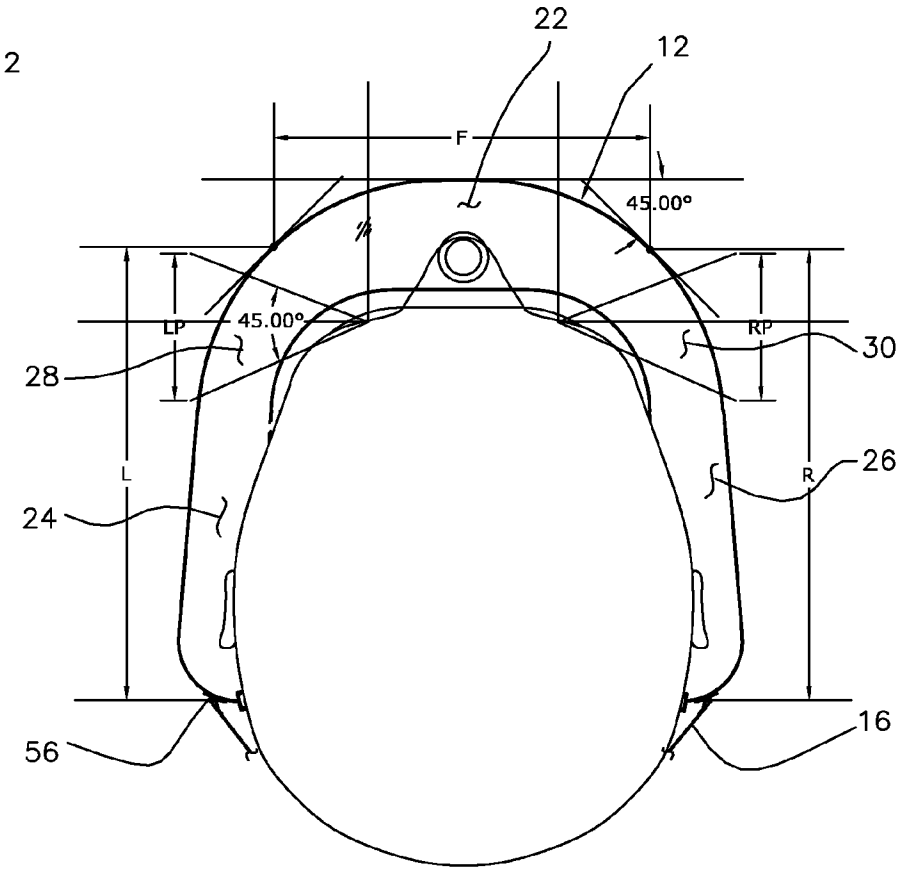
FIG. 3 is a plan view of the goggle shown in FIG. 1.

As best shown in FIG. 3, the preferred lens 12 presents a transparent front section 22 that extends across the wearer's face 18 a lateral front length, F, and transverse left and right sections 24,26. More preferably, the left and right sections 24,26 extend perpendicularly along the sides of the wearer's head, and emanate from the front section 22 at points along the horizontal curvature of the lens 12 where horizontal tangents defined by the points form a forty-five degree angle with the horizontal tangents defined by the vertical mid-line of the front section 22 (see FIG. 3).

The left and right sections 24,26 include transparent left and right sub-sections 28,30 respectively. The subsections are adjacent the front section 22 and configured so as not to obstruct the wearer's vision in the general left and right peripheral directions LP,RP, wherein the peripheral directions LP,RP are generally defined as the forty-five degree horizontal angles bisected by perpendiculars to the wearer's forward vision (see FIG. 3). To enable full periphery vision, the subsections present lengths, L and R, that are not less than one-eighth, more preferably not less than one-fourth, and most preferably not less than one-half of the lateral length, F, of the front section 22. Finally, the preferred front section 22, and left and right sub-sections 28,30 are integrally formed to present a seamless transparent lens 12.

Figure 6:
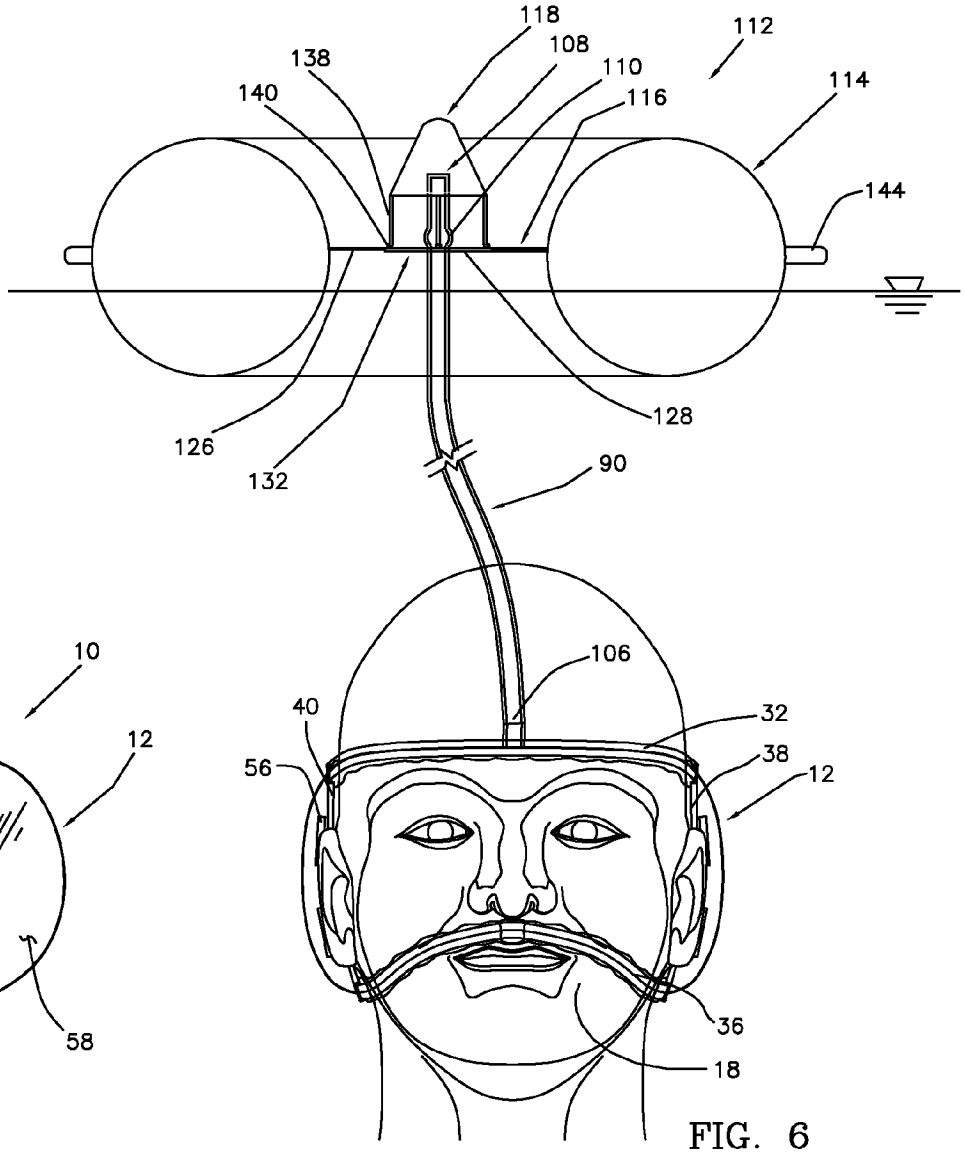
FIG. 6 is an elevation view of the remote breathing assembly, particularly illustrating the goggle being donned by a human wearer, an air-tube attached to the goggle, and a preferred embodiment of the remote breathing apparatus.

As best shown in FIGS. 1 and 6, the lens 12 defines a circumscribing edge 32 that includes generally top, bottom, left and right edges 34-40. When the goggle 10 is donned, the top edge 34 generally extends along the wearer's brow or forehead and along the sides of the wearer's head towards a point spaced above the wearer's ears. The bottom edge 36 generally extends below the wearer's eyes and the sides of the wearer's head towards a point spaced below the wearer's ears. More preferably, the bottom edge 36 generally extends below the nose of the wearer. A horizontal offset, A, is provided between the top edge 34 and bottom edge 36 to facilitate a more comfortable and uniform application of compressive force to the liner 14 (see FIG. 2). More preferably, the offset, A, is set within the range of one-quarter to three-quarter inches. The left and right edges 38,40 present generally arcuate shapes that preferably extend behind the wearer's left and right ears from said points spaced above and below the ear. Thus, the left and right edges 38,40 interconnect the top and bottom edges 34,36. It is within the ambit of the present invention, however, for the left and right edges 38,40 to extend in front of the wearer's ears, as shown in FIG. 2, where protection of the ears is not desired.

As best shown in FIG. 1*b*, the lens 12 includes a liner interface 42 that coextensively extends along the circumscribing edge 32. The interface 42 functions to provide a surface for securely attaching the compressible liner 14 to the lens 12 and for applying a broad compressive force to the liner 14. More preferably, the interface 42 presents a channel having a U-shaped configuration. The U-shaped channel is open towards the wearer's face 18, and includes a transverse panel 44 connecting two parallel side panels 46,48. The panels 44-48 cooperatively present inner and outer surfaces 50,52. The interface 42 is preferably affixed to the circumscribing edge 32 along the mid-line of the transverse panel 44. The interface 42 is adhesively attached to the liner 14 adjacent the inner surface 50 of the channel. To apply a broader compressive force, the side panels 46,48 preferably include flaps 54 that project perpendicularly outward from their unattached ends. The flaps 54 preferably present curved edges so as not to damage the liner 14 when the liner 14 is compressed.

As previously mentioned, at least one strap is coupled to the lens 12 to maintain the airtight chamber 20. More preferably, a plurality of stirrups 56 is configured to receive a plurality of straps 16, and the stirrups 56 are permanently fixed to the lens 12 by a commercially available high strength and waterproof adhesive (see FIG. 2). The bond formed by the adhesive is of sufficient strength to resist the shear stress applied by the straps under normal use. Most preferably, the stirrups 56 are integrally formed on the outer surface 58 of the lens 12. It is within the ambit of the present invention, however, for the strap ends to be integrally formed within or bonded directly to the lens 12, and for utilizing alternative structures for coupling the strap ends to the lens 12.

Turning to the construction of the lens 12, the lens 12 including the liner interface 42 is formed using conventional methods commonly known in the art, such as injection molding. For example, thermoplastic molding of a commercially available sufficiently transparent, non-brittle and lightweight polymer resin, such as a polypropylene or acrylic blend can be utilized. After molding, the goggles can be conveyed through ionized air to reduce static attraction of dust and dirt prior to dip coating with an abrasion resistant, anti-fog or tinted material commonly known in the art. More preferably, the selected resin produces an abrasion resistant, anti-fog and reflective or slightly tinted lens 12.

One of a plurality of mold designs varying in dimension provides a cast for each mold. For example, for adult sizes, twelve, fourteen and sixteen inch total lens lengths can be provided, wherein the total lens length is equal to the length of the top edge 34. These sizes further present four, four and one-half, and five inch lens heights respectively, where the lens height is vertically measured from the midpoints of the top and bottom edges 34,36, and preferably along the vertical centerline of the lens 12. More preferably, a mold can be formed according to an individual wearer's specified dimensions utilizing industry standard CAD/CAM or AutoCAD software.

The preferred lens 12 is integrally formed, including the stirrups 56 and interface 42, to present a unitary body. However, it is within the purview of the present invention to compile the lens 12 using separately constructed sections. For example, a transparent unitary body including the front section 22 and left and right sub-sections 28,30 could be sealably affixed to more durable rubber coated side sections to complete the lens 12.

As best shown in FIGS. 1-2, a compressible liner 14 forms a sealable barrier between the lens 12 and the wearer's face 18. The liner 14 preferably includes an outer membrane 60 and interstitial material 62. The membrane 60 forms an endless flexible tube having a circular cross-sectional shape, and is sufficiently sized so that a portion of the membrane 60 is able to form a superjacent relationship with the inner surface 50 of the liner interface 42. More preferably, the tube presents a diameter approximately equal to two times the inside width of the liner interface 42 as measured by the perpendicular distance between the parallel side panels 46,48.

The membrane 60 is preferably impervious to and insoluble in both fresh and sea water, but permeable to oxygen and water vapor. The membrane 60 is also impermeable to microorganisms. One such suitable material 62 is commercially available as Tegaderm® HP Transparent Wound Dressing produced by 3M, and comprises a thin polyurethane membrane 60 coated with a layer of an acrylic adhesive. Alternatively, other commercially available thin flexible materials that are impervious to water, such as a rubber or plastic liner, may be utilized. Finally, all seams or ribs presented by the tubular configuration of the membrane 60 are preferably oriented towards the liner interface 42, so as to present seamless contact with the wearer's face 18.

The preferred interstitial material 62 is a compressible fluid mass, i.e. a urethane or soft silicone gel, that is able to conform to the inside dimensions of the liner interface 42. The material 62 displaces only a portion of the inside volume of the membrane 60 so as to enable the material 62 to flow therein. In order to further enhance view-ability the preferred interstitial material 62 is also transparent. However, the material 62 may be fluorescent, so as to be viewable in darkness.

Alternatively, the membrane 60 and material 62 of the liner 14 may be integrally formed of gelatinous material as disclosed in U.S. Pat. No. 6,152,137 incorporated by reference herein. Other materials such as flowable rubber and self-retained silicone elastomers could also be utilized.

The outer membrane 60 of the liner 14 is attached to the inner surface 50 of the interface 42 by an adhesive strip 64 which bonds the two together and preferably forms an airtight seal therebetween. The adhesive strip 64 presents a water insoluble layer and a bonding contact area sufficient to provide a constant bond between the liner 14 and interface 42 under normal use. More preferably, the strip 64 coextensively extends along the entire inner surface 50 of the liner interface 42. An example of suitable adhesive strip material is available as part no. 80242 (ss-h) under the brand name Silicone Sealer, by Duro. However, other suitable commercially available waterproof adhesives, such as super glue, may also be utilized. Alternatively, an impervious head mask (not shown) defining an opening adjacent the wearer's eyes and nose can initially be donned to facilitate the formation of a seal between the liner and the wearer's face.

Figure 4:
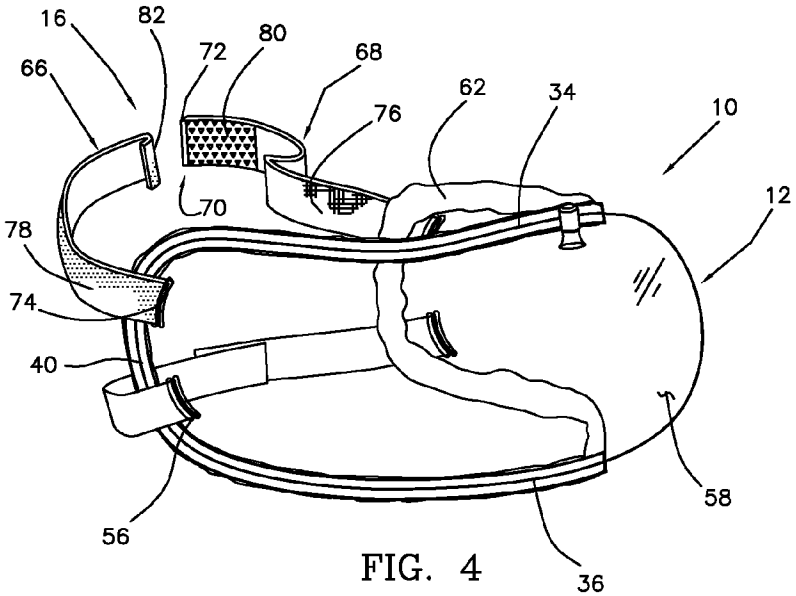
FIG. 4 is a perspective view of the goggle shown in FIG. 1, particularly illustrating the straps.

In the illustrated embodiment shown in FIGS. 1, 2 and 4, two straps 16 are coupled to the lens 12 to secure the goggle 10 and form an airtight chamber 20 adjacent the wearer's face 18. Each of the straps 16 preferably presents two strap sections 66,68, and an adjustable self-fastening mechanism 70 coupled thereto. Each section defines free and attached ends 72,74 relative to the goggle 10, and inner and outer surfaces 76,78 relative to the wearer's head. Alternatively, each strap 16 presents a single unitary band having two adjustably fastenable ends, wherein one end is received through the stirrups prior to being doubled over to fastenably engage the opposite unreceived end.

At least one of the straps 16 is preferably formed of stretchable material. More preferably, at least one of the straps 16 is formed of an elastic material comprising a spandex core polyester yarn or interwoven spandex filaments. However, any suitable commercially available non-degradable elastic strap can be utilized.

In the illustrated embodiment, the self-fastening mechanism 70 includes hook and loop patches 80,82 that are affixed to the straps 16 and able to interconnect when brought to bear against one another. The hook and loop patches 80,82 present a total grab strength along a contact plane that is sufficient to withstand the anticipated shearing stresses encountered along the plane during normal use. Most preferably, where the straps 16 are each presented as one discontinuous band, the loop patch 82 presents one continuous strip and is affixed to one surface of the strap, while the hook patch 80 is affixed to the opposite surface at one end. Where each of the straps 16 comprises two sections 66,68, the loop patch 82 coextensively covers the entire outer surface 78 of one of the sections, while the hook patch 80 is affixed to the other section on the inner surface 76 and adjacent the free end. One such hook and loop fastener is commercially available under the trademark "VELCRO" from the Velcro Industries B.V. LTD LIAB CO NETHERLANDS Castorweg 22-24 of Curacao NETHER- LANDS. However, other conventional means of adjustably fastening the strap ends, including buckles, snaps, pins, clips and a combination thereof may be utilized.

As best shown in FIG. 1*a*, the goggle 10 preferably includes a semi-flexible air-tube stub 84 fixedly attached to the lens 12. More preferably, the stub 84 is attached to the front section 22 of the lens 12 near the top edge 34, so as not to obstruct the forward vision of the wearer. The preferred stub 84 presents an open generally tubular body having a circular cross-section, and open lower and upper stub ends 86,88. The stub 84 is coaxially aligned with an orifice defined by the lens 12, so that the open upper stub end 88 communicates with the now penetrated air-tight chamber 20. The lower stub end 86 preferably presents a cross-sectional diameter that is larger than the upper end 88 to present a tapered configuration. More preferably, the edge formed by the lower stub end 86 and the lens 12 is curved to present a funnel, so that energy loss associated with the orifice is reduced. Most preferably, the curvature presents a radius not less than one-sixteenths of an inch.

The stub 84 includes an externally threaded portion 92 adjacent the upper stub end 88, and a resultant non-threaded portion 94. The threaded portion 92 presents a threaded diameter equal to or less than the outer diameter of the non-threaded stub 84 portion, so that a ledge 96 is formed at the abutment therebetween. Preferably, the stub 84 is also transparent, and the stub 84 and lens 12 are integrally formed so as to present one unitary body.

An internally threaded stub cap 98 presenting an outer surface 100 is provided for sealably engaging the threaded portion 92 of the stub 84 and enclosing the open upper stub end 88, so that an air-tight chamber is again presented. The cap 98 presents a full width axial length that is slightly longer than the axial length of the threaded portion 92, so that the cap 98 when fully received contacts the ledge 96 and seals the open upper end 88. The outer surface 100 of the cap 98 is textured, i.e., knurled, serrated, etc., to present a non-slip surface that facilitates the tightening and removal of the cap 98, even where wet.

Figure 5:
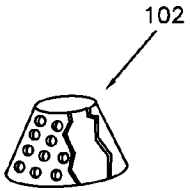
FIG. 5 is an enlarged perspective view of an embodiment of the filter cap.

Alternatively, the stub cap 98 can be pervious to air and preferably lined with at least one layer of filtrating material commonly known in the art, to form a filter cap 102 (see FIG. 5). It is appreciated that the filter cap 102 functions to prevent particulate matter, such as dust, from entering into the inner chamber 20. In this arrangement, the filter cap 102 may further include a complete layer of material capable of filtering biologically and/or chemically hazardous particulate matter.

As shown in FIG. 1*a*, a compressible seal ring 104 having an inner diameter that is less than the outer diameter of the non-threaded portion 94 is preferably provided adjacent the ledge 96. More preferably, the ring is formed of a non-reactive elastic rubber material and presents an inner diameter that is slightly smaller than the outer diameter of the stub 84 adjacent thereto, so that the ring snugly encircles the stub 84.

As best shown in FIG. 6, where the cap 98 is unattached to the air-tube stub 84, the threaded portion 92 of the stub 84 is able to sealably receive an internally threaded female end 106 of the air-tube 90. The female end 106 of the air-tube 90 presents a threaded length slightly longer than the length of the threaded portion 92 of the stub 84, so that the air-tube 90 abuts the ledge 96 when threadably received over the entire threaded portion 92 of the stub 84. More preferably, the seal ring 104 is interposed between the ledge 96 and female end 106 to further prevent the infiltration of fluid into the open upper end 88 of the stub 84. Finally, a retaining element (not shown) can be provided to prevent the unwanted detachment of the air-tube 90 from the stub 84.

The air-tube 90 also presents an upper male end 108 opposite the female end 106, and an enlarged portion 110 near the male end 108. The enlarged portion 110 presents a diameter that is not less than the outside diameter of the air-tube 90. More preferably, the enlarged portion 110 presents a spherical configuration having an outer diameter not less than one and one-quarter times the outer diameter of the air-tube 90. Alternatively, the male end 108 can be threaded consistently with the threaded portion 92 of the stub 84, so as to enable interconnection of multiple air-tubes, where desired. In this arrangement, the female end 106 of a second air-tube threadably engages the male end 108 of a first air-tube.

The air-tube 90 either singularly or conjointly presents an overall length that is not greater than the maximum depth at which the goggle 10 can be safely operated. More preferably, the length of the air-tube 90 is within the range of one to ten feet, and most preferably, between the range of three to five feet.

Figures 7, 7A:
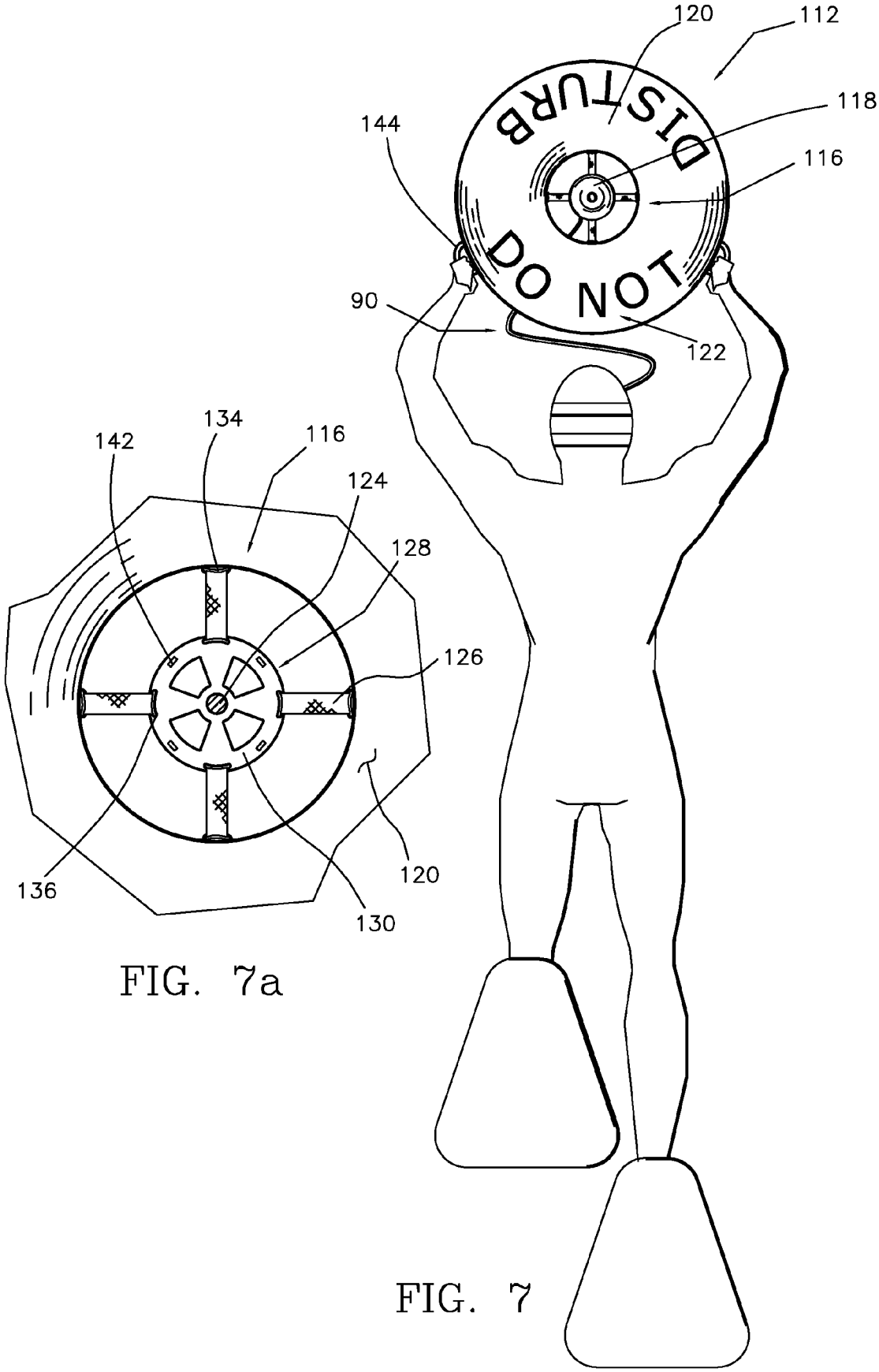
FIG. 7 is a plan view of the assembly shown in FIG. 6 being operated by the wearer.
FIG. 7*a* is a fragmentary planar view of the apparatus shown in FIG. 6, particularly illustrating the web.

Turning to FIGS. 6, 7 and 7*a*, the remote breathing apparatus 112 is shown coupled to the air-tube 90 adjacent the enlarged portion 110. The apparatus 112 functions to hold the upper end 108 of the air-tube 90 in a desired location or condition, i.e. above a water surface. The illustrated apparatus 112 includes a buoyant floatation device 114, a web 116 and a cover 118 connected to the web 116. It is within the purview of the invention, however, to utilize other devices for retaining the upper end 108 of the air-tube 90 in a desired location or condition. For example, an adjustable belt can be provided for coupling the air-tube 90 to a given object, such as an existing innertube or swimming pool rail. Other alternative devices include a suction for attaching to surfaces and a hook for engaging the upper edge of a panel.

The floatation device 114 includes an inflatable innertube 120. The inflatable innertube 120 is formed of a flexible lightweight membrane and presents a sealable orifice for inflating and deflating as is commonly known in the art. The membrane is capable of displaying water-insoluble images and indicia 122, such as "DO NOT DISTURB," or "SNORKEL MATE." Alternatively, the entire above surface portion of the floatation device 114 may be transparent, where discrete operation is desired.

When inflated, the innertube 120 preferably presents a circular configuration having an outside diameter and an open space defined by an inside diameter. The preferred innertube 120 further presents a circular cross-section when fully inflated. Alternatively, however, an elliptical cross-sectional shape on the bottom half of the innertube 120 can be provided, wherein the major axis radially extends through the center point of the innertube 120. It is appreciated by those skilled in the art that the elliptical configuration provides greater fluid displacement per incremental unit of depth. The preferred innertube 120 presents an outside diameter within the range of about one to three feet and an inside diameter within the range of about four to eight inches. The inner and outer diameters are varied to present a buoyant force that is substantially greater than the anticipated submerging forces generated by the wearer under normal use. More preferably, the innertube 120 is sized to present a forgiving buoyant force that resistively signals to the wearer that the maximum operable depth has been reached, while offering some flexibility.

As best shown in FIG. 7*a*, the floatation device 114 also includes a rigidly flexible web 116 for coupling the upper end 108 of the air-tube 90 to the innertube 120 at a desired elevation above the water surface. The web 116 is preferably attached to the innertube 120 along a radially inner circle on the upper half of the innertube 120. The web 116 presents a predominately open matrix and defines a central opening 124 that is slightly larger than the outside diameter of the air-tube 90 and smaller than the diameter of the enlarged portion 110 of the air-tube 90. The web 116 is preferably formed by a plurality of rigidly flexible bands 126 and a circular donut shaped disc 128 presenting upper and lower surfaces 130,132. The disc 128 preferably presents an outside diameter within the range of about two to four inches. The bands 126 are attached to the innertube 120 and disc 128 via a plurality of sleeves 134 securely affixed to the innertube 120 and a plurality of slots 136 defined by the disc 128. The bands 126 are formed of an elastic fabric that is capable of being increasingly stretched between the innertube 120 and disc 128 as the innertube 120 inflates. Each one of the bands 126 is, therefore, tensioned so as to present a rigidly flexible web 116 in the normal operating position. The bands 126 are able to further stretch to a maximum length, wherein the upper end of the air-tube 90 remains above the water surface. Thus, the resistive elasticity of the bands 126 also indicates to the wearer that the maximum depth has been reached.

As best shown in FIG. 6, preferably attached to the disc 128 on the upper surface 130 and near the outer edge is a rigid conical cover 118 for preventing splashed water from entering into the open upper end 108 of the air-tube 90. The vertical centerline of the preferred cover 118 is coaxially aligned with the central opening 124 defined by the web 116. Below the upper end 108 of the air-tube 90 a plurality of legs 138 emanate from the edge of the cover 118 to a point adjacent the outer edge of the disc 128. The lowermost edge of the cover 118 presents a circular cross section having a diameter equal to the outer diameter of the disc 128 so that the legs 138 are generally vertical. The legs 138 are spaced and the cover 118 is configured to allow sufficient airflow into the upper end of the tube. More preferably, the cover 118 is attached to the disc 128 via four legs 138 spaced apart at each quadrant of the disc 128. The web 116, disc 128, and cover 118 are all formed of a suitable rigid and water-insoluble material, such as plastic.

Figure 6A:
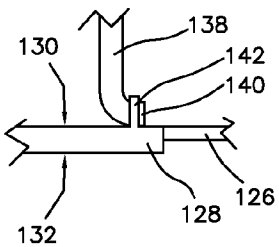
FIG. 6*a* is a fragmentary elevation view of the remote breathing apparatus, particularly illustrating a bent foot and bracket interconnection.

As typically shown in FIG. 6*a*, the preferred legs 138 and disc 128 are releasably connected, so that the cover 118 is removable. The lowermost point of each of the legs 138 presents a bent foot 140 projecting radially outward a foot length distance. The disc 128 at each connection point forms a bracket. Each bracket 142 has a side depth that is less than the foot length and defines a foot opening (not shown) having sufficient dimensions to receive the foot 140. More preferably, the foot length distance is one-eighths of an inch.

Finally, the preferred floatation device 114 includes at least one arcuate shaped handle that is permanently affixed to the innertube 120 along the outer circumference. More preferably, as shown in FIG. 7, a plurality of handles 144 is provided, wherein the handles 144 are spaced ninety-degree arc lengths apart.

In operation, the lower female end 106 of the air-tube 90 is passed through the central opening 124 of the web 116 with the upper disc surface 130 and brackets 142 facing upward. The air-tube 90 is pulled through the opening until the enlarged portion 110 is adjacent the disc 128. The cover 118 is then snapped into place, by inserting each foot 140 into one of the foot openings. The innertube 120 is then fully inflated to stretch the web 116 to the normal operating position shown in FIG. 6. The lower end of the air-tube 90 is screwed onto the stub 84 of the goggle, with the seal ring 104 in place, so that the seal ring 104 is compressed between the stub ledge 96 and air-tube 90. The goggle 10 is then donned, so that the top edge 34 of the lens 12 extends above the eyes and the bottom edge 36 extends below the nose of the wearer. The straps 16 are tightened around the head of the wearer to compress and conform the liner 14 to the contours of the wearer's face 18, so that a seal is formed between the lens 12 and the wearer's face 18.

As shown in FIG. 7, once the goggle 10 is donned and the floatation device 114 is properly attached, the wearer can view underwater environments at his or her leisure by gripping the handles 144 of the floatation device 114 and swimming in a generally freestyle position with his or her head at least partially submerged in the water. Finally, since the wearer's hands are not available for propulsion in this position, fins are preferably utilized.

Figures 8, 8A, 9:
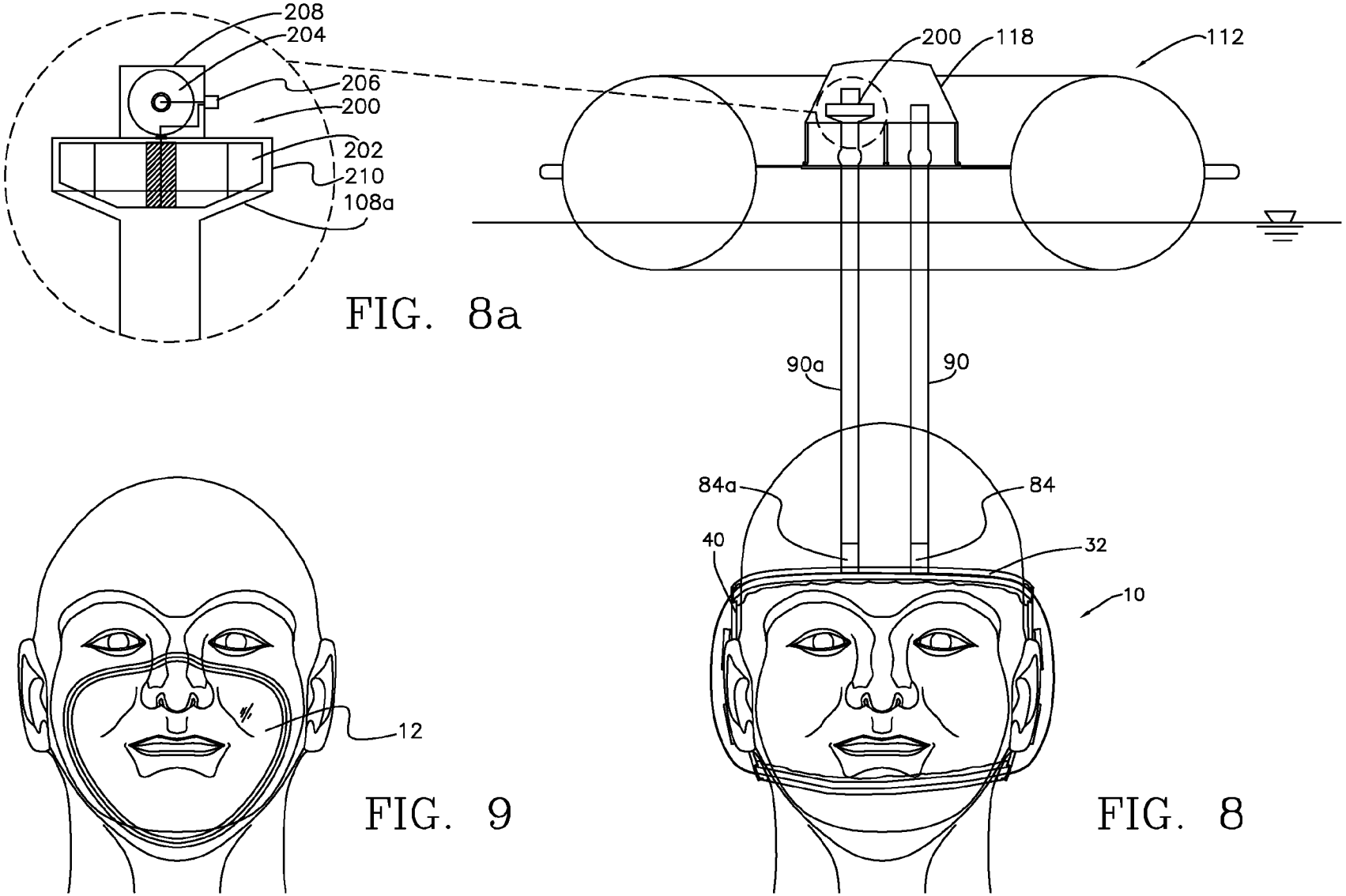
FIG. 8 is a front elevation view of a second embodiment of the present invention, particularly illustrating the goggle, apparatus, and an intake and return breathing tubes.
FIG. 8*a* is an enlarged segmental view of the upper end of the intake tube shown in FIG. 8, particularly illustrating a blower attached thereto.
FIG. 9 is an elevation view of a mask in accordance with a preferred embodiment of the present invention.

In further embodiments of the present invention, FIGS. 8 through 14 illustrate various additional features and aspects of the goggle 10 and remote breathing apparatus 112. In FIG. 8 the goggle 10 is shown as having a lower edge that extends below the mouth of the wearer so as to present a mask (see also FIG. 12). It is appreciated that the goggle in this configuration enables both nasal and oral breathing, as well as provides additional volume for retaining air. Alternatively, and as shown in FIG. 9, the lens 12 of the mask may not cover the eyes of the wearer and may instead cover the lower half of the face including the nose and mouth, so as to enable the wearer to use conventional goggles or unobstructed vision.

Figure 10:
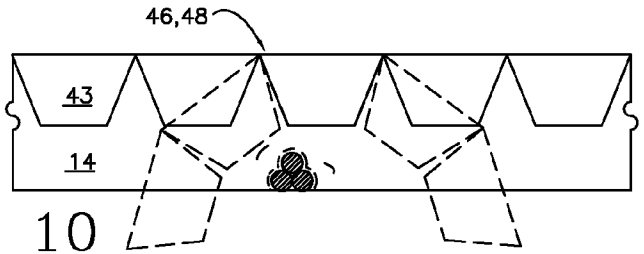
FIG. 10 is an enlarged segmental view of the goggle interface and liner in accordance with a preferred embodiment of the invention, particularly illustrating trapezoidal projections.
Figure 11:
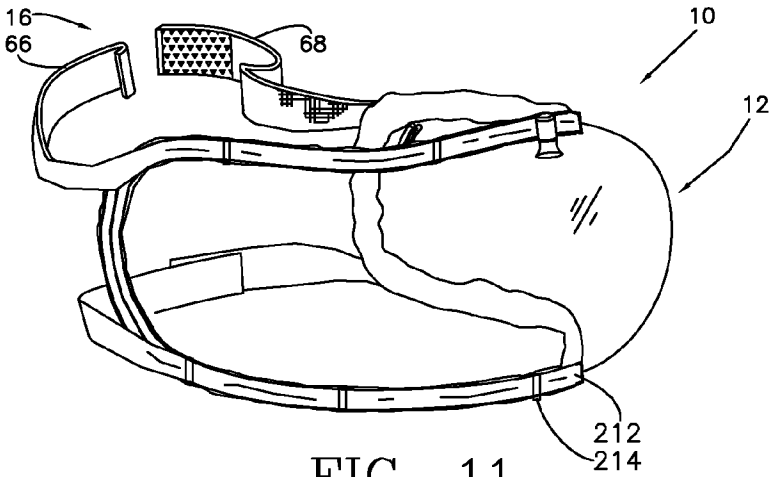
FIG. 11 is a prospective view of a goggle in accordance with a preferred embodiment of the invention, particularly illustrating straps having intermediate sections superjacently overlaying the interface along the upper and lower edges of the lense, and a plurality of guides for securing the section.

As shown in FIG. 10, the U-shaped liner interface 42 preferably presents lateral walls 46,48 that define a series of trapezoidal projections 43 and intermediate isosceles gaps. This configuration, it is appreciated further facilitates the lens ability to flex; however, it is also appreciated that less liner interface is provided for adhesion.

Figure 12:
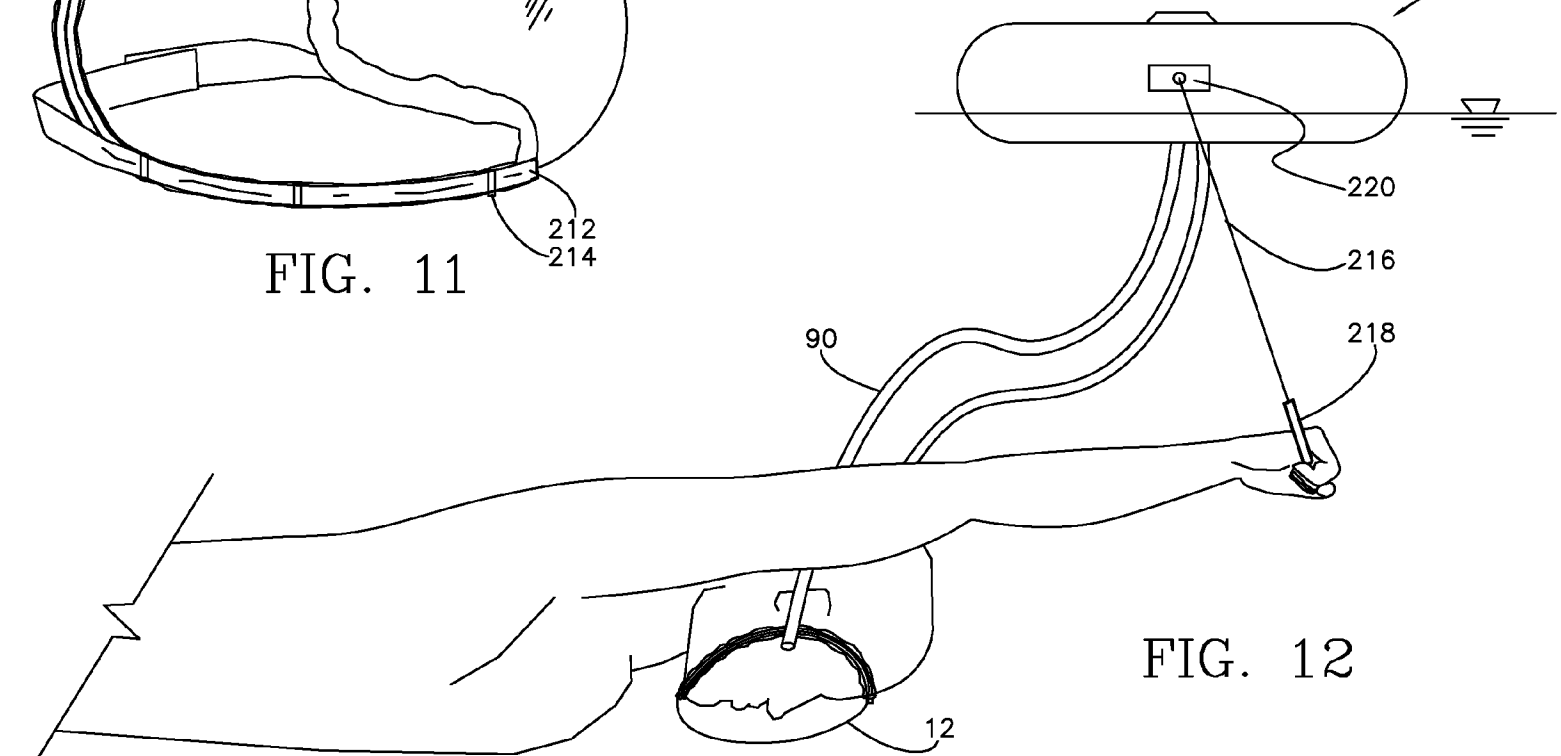
FIG. 12 is a side elevational view of a human wearer, a mask, intake and return tubes, and a remote breathing apparatus having a link and submersible handle.

Returning to FIG. 8, the preferred goggle 10 is configured to interconnect with a second breathing tube 90*a* so as to provide intake and return air ducts. In this configuration, the lens 12 defines a second stub 84*a* spaced from the first stub 84, and the goggle 10 further includes a second stub cap (not shown). More preferably, the stubs are spaced along the front section as shown in FIG. 8. Most preferably, the intake and return air tubes 90,90*a* are spaced so as to interconnect with the left and right sections 24,26 (FIG. 12). In this configuration, either of the tubes 90,90*a* more preferably includes a miniature blower 200 attached to the free end. The blower 200 is configured to cause ambient air adjacent the tube end to flow into the tube and subsequently through the chamber 20 and opposite tube.

An exemplary embodiment of the blower 200 is best shown in FIG. 8*a*, wherein a wire-wound motor (or rotary fan) 202 is coupled to and powered by a portable power source 204, such as one AA battery, and an on/off switch 206 is intermediately connected to the source 204 and motor 202. The switch 206 is conventionally configured to selectively activate the motor by completing a circuit in the "on" position. The blower 200 preferably includes a water-tight housing 208 for protecting the battery 204, switch 206 and circuit from moisture, wherein said housing presents the necessary seals that enable the wire leads (not shown) and a portion of the switch to protrude from the housing 208. Finally, the blower 200 preferably includes a motor casing 210 for interconnecting with the upper tube end 108. The upper end 108 preferably presents a flared end section 108*a* for funneling air into the tube.

In the dual tube configuration, the remote breathing assembly is modified to accommodate the second tube 90*a*. More particularly, the web 116 shown in FIG. 7*a* is modified to present a second circular opening similar to the first 124, and the cover (or splash guard) 118 is widened so as to prevent wayward water from entering two tube ends securely retained above the water surface by the web 116.

Also shown in FIG. 10, the compressible liner 14 is more preferably configured to form generally superjacent layers around a tubular member having a diameter of approximately 100 micrometers, such as a coarse hair follicle, and more preferably a bundle of like tubular members having an aggregate diameter of 1 millimeter. This enables the liner to form a bond around most human facial hair follicles that may be intermediately compressed by the goggle 10.

In another embodiment, the straps 16 for compressing the liner may include an intermediate section 212 as shown in FIG. 13, between the two strap sections 66,68. The goggle 10 further includes a plurality of guides 214 fixedly attached to the lens 12 near the interface 42 and configured to receive the intermediate strap section 212. In this configuration, it is appreciated that compression is performed evenly over the interface 42 along the top and bottom edges 34,36. Each guide 214 preferably presents a seat having an open end, such that the strap section 212 is able to slide in and out. More preferably the guides 214 are integrally formed with the interface 42 or lens 12.

In another embodiment of the remote breathing apparatus 112 includes at least one link 216 presenting a distal end and link length, and a submersible handle 218 attached to the distal end of the link 216 (FIG. 14). More preferably, a plurality of two identical and spaced apart links and handles are provided for engaging the left and right hands of the wearer as he or she swims. The link 216 may be a rope, chord or chain, and the link length is preferably less than the tube length, but greater than one-half of the tube length. The handle 218 presents a specific gravity greater than water so as to sink when allowed to by the link. More preferably, the apparatus 112 further includes a link storage attachment 220, for storing the link 216 when not in use. In this configuration, the preferred link 216 is retractable towards a wound condition within the storage attachment 220. Most preferably, the link 216 is biased towards the wound condition. For example, a rotational spring (not shown) and wheel (also not shown) may be included in the storage attachment 220.

The preferred forms of the invention and mode of operation described above are to be used as illustration only, and should not be utilized in a limiting sense in interpreting the scope of the present invention. Obvious modifications to the exemplary embodiments, as set forth herein, could be readily made by those skilled in the art without departing from the spirit of the present invention.

The inventor hereby states his intent to rely on the Doctrine of Equivalents to determine and assess the reasonably fair scope of the present invention as pertains to any apparatus 112 not materially departing from but outside the literal scope of the invention as set forth in the following claims.

I claim:

1. A periphery viewable goggle for protecting a portion of a wearer's face, including the eyes, from externalities, and for providing the wearer with seamless peripheral viewing, said goggle comprising:

a flexible lens having transparent front, left and right sections, wherein said front section defines a lateral front length, and said left and right sections each extends transversely from the front section, presents a length not less than one-forth of the lateral front length, and forms no seam with the front section;

a compressible liner attached to the lens, and configured to form a seal between the lens and the wearer's face; and a securing element for securing the lens in a fixed position relative to the wearer's face, and compressing the liner, so as to form an air-tight chamber between the lens and the portion of the wearer's face, when the goggle is donned.

2. The goggle as claimed in claim 1, said lens including a U-shaped liner interface presenting an inner surface, wherein said liner is adhesively attached to the inner surface, and presents two opposite walls comprising a plurality of longitudinally oriented trapezoidal sections, so as to facilitate the flexure of the lens.

3. The goggle as claimed in claim 1, said liner being operable to form superjacent layers with and completely envelop the exposed section of a tubular member having a diameter of at least 1 millimeter, when compressed against the member.

4. The goggle as claimed in claim 1, said portion of the wearer's face including the nose, said lens defining an upper edge laterally extending above the eyes, a lower edge laterally extending below the nose, and an orifice;

an air-tube stub sealably attached to the lens and presenting a tubular body defining an open upper stub end, wherein said body is coaxially aligned with the orifice, so as to fluidly intercommunicate the airtight chamber and upper stub end; and a stub cap removably fastened to the upper stub end and operable to prevent the infiltration of fluid into the upper stub end.

5. The goggle as claimed in claim 4, wherein said portion of the wearer's face further includes the mouth, and said liner defines an upper edge laterally extending above the eyes, a lower edge laterally extending below the mouth.

6. The goggle as claimed in claim 1, further comprising:

a flexible air tube presenting a first open end that is sealably attached to the lens, an interior space, and a second open end opposite the first end; and a remote breathing apparatus coupled to the air tube at a location spaced from the first end, and configured to retain the second end of the tube in a generally fixed condition, said lens defining an orifice adjacent the interior space, so that said chamber is fluidly coupled to the second open end of the tube, when the goggle is donned.

7. The goggle as claimed in claim 6, wherein the apparatus includes a floatation device, and is configured to secure the second end of the tube above a water surface.

8. The goggle as claimed in claim 7, wherein the apparatus further includes a concave splash guard defining an interior space, and the second end of the tube is secured in a fixed position within the interior space.

9. The goggle as claimed in claim 7, wherein the apparatus is transparent.

10. A periphery viewable goggle for protecting a portion of a wearer's face, including the eyes, from externalities, and for providing the wearer with seamless peripheral viewing, said goggle comprising:

a concave lens defining a continuous edge and having transparent front, left and right sections, wherein said edge further defines laterally extending upper and lower edge sections, the front section defines a lateral front length, and said left and right sections each extends transversely from the front section and presents a length not less than one-eighth of the lateral front length;

a compressible liner attached lens adjacent the edge, and configured to form a seal between the lens and the wearer's face; and a securing element for securing the lens in a fixed position relative to the wearer's face, and compressing the liner, so as to form an air-tight chamber between the lens and the portion of the wearer's face, said element including at least one strap presenting an intermediate section, said lens further defining a plurality of guides adjacent the upper and lower edge sections, said at least one strap, liner and lens being cooperatively configured such that the guides are able to receive at least a portion of the intermediate section, and the intermediate section forms superjacent layers with the liner and lens generally adjacent the upper and lower edge sections, when received.

11. A remote breathing assembly adapted for use with a human wearer in a body of water defining a water surface, said assembly comprising:

a face mask including a water-impermeable outer shell and a compressible liner, and configured to engage a portion of the face, including the nose or mouth, of the user such that the portion and shell cooperatively form an enclosed space adjacent said nose or mouth, when the mask is donned;

a securing element configured to compress the liner against the face of the user, so as to seal the enclosed space, and secure the mask in a fixed position relative to the portion;

a first breathing tube defining an open inner tube space, a first tube end securely interconnected with the shell at a first location, a second tube end, and a tube length; and a remote breathing apparatus configured to float upon the surface and securely coupled to the tube at or near the second end, such that the second end is retained in a relative fixed condition above the water surface, said shell defining an opening at the first location such that the tube and enclosed spaces are fluidly coupled.

12. The assembly as claimed in claim 11, wherein the apparatus includes at least one link presenting a distal end and link length, and at least one submersible handle attached to the distal end of each link.

13. The assembly as claimed in claim 12, wherein the link length is less than the tube length, but greater than one-half of the tube length.

14. The assembly as claimed in claim 12, wherein the apparatus further includes a link storage attachment, said link is retractable towards a wound condition within the storage attachment, and said link is biased towards the wound condition.

15. The assembly as claimed in claim 11; and a second breathing tube defining an open inner second tube space, a first second tube end securely interconnected with the shell at a second location spaced from the first location, a second second tube end, and a second tube length, said shell defines a second opening at the second location such that the inner tube spaces of the first and second tubes are fluidly coupled through the enclosed space, said apparatus being securely coupled to the second tube at or near the second end so as to retain the second end in a relative fixed condition above the surface.

16. The assembly as claimed in claim 15; and a blower securely coupled adjacent the second end of the first or second tube, and configured to cause ambient air to flow into said ether first or second tube and out of the other of said first or second tube.

17. The assembly as claimed in claim 16, wherein said second end of the first or second tube has a flared end section configured to funnel ambient air towards the inner tube space.

18. The assembly as claimed in claim 16, wherein the apparatus further includes a concave splash guard defining an interior space, and the second end of the first and second tubes, and blower are secured in generally fixed positions within the interior space.

19. The assembly as claimed in claim 16, wherein the blower includes an electric motor, a battery configured to power the motor, and an on/off switch intermediate the battery and motor and configured to selectively activate the blower.

20. The assembly as claimed in claim 19, wherein the blower includes a generally water-proof housing configured to enclose the battery and switch.

* * * * *